United States Patent [19]

Lorenzen

[11] Patent Number: 4,473,164

[45] Date of Patent: Sep. 25, 1984

[54] HELICALLY FORMED CONTAINER OF THE DRUM TYPE

[76] Inventor: Jan A. Lorenzen, P.O. Box 211 B 1, R.F.D. 3, Englishtown, N.J. 07726

[21] Appl. No.: 411,144

[22] Filed: Aug. 25, 1982

[51] Int. Cl.[3] ..... B65D 8/20

[52] U.S. Cl. ..... 220/5 R; 220/67; 220/76; 220/77; 220/85 K; 229/4.5

[58] Field of Search ..... 138/154, 157, 163, 168, 138/155, 156; 43/77, 4, 5, 6; 229/4.5, 5.6; 493/393, 109, 108, 299, 297, 158, 159, 102, 103, 104; 220/76, 67, 62, 75, 77, 85 K, 5 R

[56] References Cited

U.S. PATENT DOCUMENTS

| | | | |
|---|---|---|---|
| 521,621 | 6/1894 | Lindemann | 138/163 X |
| 1,366,621 | 1/1921 | Wood . | |
| 1,643,252 | 9/1927 | McCrery | 220/75 X |
| 1,692,529 | 11/1928 | Zagorski | 138/157 X |
| 1,891,535 | 12/1932 | Griffith . | |
| 2,633,095 | 3/1953 | Masill et al. | 413/5 |
| 3,029,504 | 4/1962 | Nielsen | 138/154 X |
| 3,094,147 | 6/1963 | Nemer | 138/154 X |
| 3,122,115 | 2/1964 | Siegwant | 138/154 X |
| 3,179,284 | 4/1965 | Valyi | 220/75 |
| 3,478,921 | 11/1969 | Bartels | 220/62 |

FOREIGN PATENT DOCUMENTS 1354384 1/1964 France .

*Primary Examiner*—Allan N. Shoap

*Attorney, Agent, or Firm*—Sperry, Zoda & Kane

[57] ABSTRACT

A cylindrically shaped, drum-type container includes a barrel formed of one or more like, helically wound lengths of skelp having contacting longitudinal edges interlocked in rolled seams following the helix. By forming corner notches in the several lengths of skelp, recesses are defined by communicating notches of adjacent lengths, at the opposite ends of each helical seam. The recesses provide clearance for rolling the ends of the lengths of skelp into interlocking engagement with the peripheries of a pair of drum heads. The helical seams, and also the peripheral seams connecting the barrel to the drum heads, are adapted to be filled with a flowable sealant, in those containers that must be made fluid-tight against the loss of liquid materials confined therein.

10 Claims, 9 Drawing Figures

HELICALLY FORMED CONTAINER OF THE DRUM TYPE

BACKGROUND OF THE INVENTION

1. Field of the Invention

The present invention relates generally to receptacles having cylindrical bodies, in particular those cylinders that are formed of metal and are secured at both ends to heads that typically are also formed of metal.

In a more particular sense, the invention comprises a metallic receptacle, and a method of making said receptacle, wherein the cylinder or barrel comprises a helically wound panel or panels, adjacent longitudinal edges of which are crimped into engagement with each other, with the ends of the panels being similarly crimped or rolled into a secure connection to the peripheries of the drum heads.

2. Description of the Prior Art

Containers of the drum type having cylindrical barrels crimped into engagement with the peripheries of the container ends, the barrels being formed of helically wound strips, are known in and of themselves. However, those containers in which the barrels are helically wound are of fibrous or paperboard stock, which presents no particular difficulties in winding the same into a helical form, and in thereafter roll-forming or crimping the resulting ends of the cylindrical body portion into engagement with container ends that in some instances are formed wholly of metallic material.

When drum type containers must be formed of metal (as is true, for example, of large containers in which heavy flowable materials are shipped), the methods used for manufacturing container barrels of fibrous stock must be discarded. Typically, conventional metal shipping drums comprise tubular barrels to which flat ends are attached to form the complete drum. Usually, the barrel is formed by welding a flat sheet of metal into a hoop shape and then deforming (or reforming) the hoop so that it will remain generally circular in cross-section. The weld joint extends in parallel relation to the drum axis. In even older forms of shipping drums or containers, the joint was closed by rivets.

In such containers, the heads have in general been attached to the barrel by means of welds, clamps, or by rolled or crimped seams. A typical crimped or rolled joint for a head of a container of this type is of a double overlap type, with the drum head being slightly recessed. A flowable sealant often fills the crimped seam for the purpose of preventing leakage.

Conventional practice imposes certain limitations in the manufacture of the barrels. Ordinarily the material used is a low-carbon, uncoated steel. Though other metals may be utilized, they offer a progressively greater scale of difficulty, especially with respect to the welded joints. Welding, indeed, precludes the use of pre-coated materials, since the heat required in the welding step destroys almost all available coatings. As a result, the conventional practice is to apply coatings after manufacture, and this has produced problems both with respect to quality control and to cost.

Another problem that has been encountered with respect to conventional metal drums of the type described above has to do with the tendency toward damage resulting from forcible impact of one drum against another during transportation. In conventional practice, most drums have two or three "rolling rings" formed in the barrel. These are used to maintain circularity. In a typical casualty situation, a small space develops between adjacent drums. An external force may be applied, as a result of which the drums tip, the present rings pass each other, and thereafter come into contact with the softer intermediate plating. Since the rings are deliberately stiff, the intermediate plating is deformed, often leading to major damage to the drum and possible loss of the cargo.

SUMMARY OF THE INVENTION

In accordance with the present invention, there is provided a container of the drum type in which the barrel or cylinder of the container is formed from one or a plurality of like, longitudinally contacting, helically wound panels, readily provided in sheet or coil form. Each panel, along its opposite longitudinal edges, is adapted to be crimped or rolled into interlocking engagement with the adjacent longitudinal edges of similar panels disposed at opposite sides thereof, and the several interlocked panels are wound helically to produce a cylindrical barrel.

The several corners of each panel are notched, in such a way as to define recesses at the opposite ends of the crimped seams connecting adjacent panels, when the barrel is completed. These recesses provide clearance for rolling the ends of the barrel into crimped engagement with the peripheries of recessed drum heads, to complete the drum structure.

If desired, and depending upon the particular product that is to be shipped within the container, sealant can be applied both to the helical, longitudinal seams connecting adjacent panels to each other, and to the seam between the barrel ends and the drum heads, thus providing a liquid-tight container should the nature of the confined product dictate the necessity thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
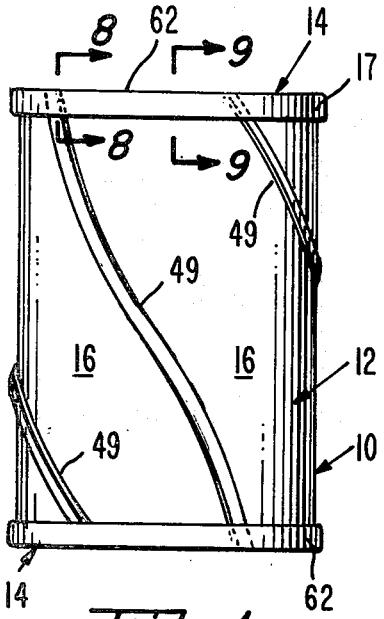
FIG. 1 is a side elevational view of a container of the drum type formed in accordance with the present invention.
Figure 2:
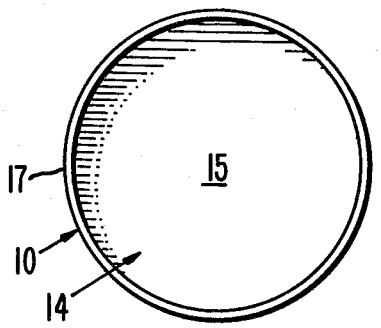
FIG. 2 is an end elevational view thereof.

The container constituting the present invention has been generally designated 10 in the several figures of the drawing, and is of the so-called drum type, that is, the container includes circular ends affixed to a relatively large diameter, cylindrical body or barrel generally designated 12.

In the illustrated embodiment, the ends or heads of the drum have been generally designated 14 and in a typical embodiment would be identical to each other, with recessed circular end panels 15 formed integrally with circumferential continuous flanges 17 rolled or crimped into engagement with end edge portions 18 of a plurality of side wall panels 16.

Figure 5:
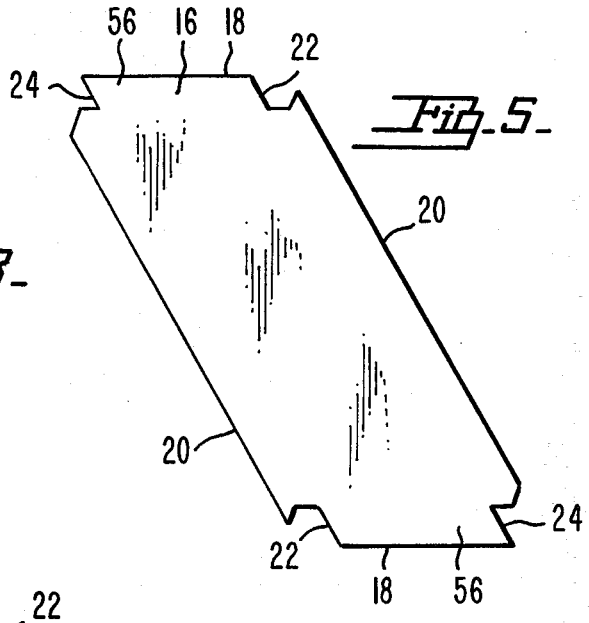
FIG. 5 is an elevational view of the blank from which one of the panels is formed.

Panels 16 are identical to one another, so the description of one will suffice for all. In FIG. 5, there is shown one of the side wall panels in blank form, and it may be noted at this time that said blank would be completely flat, in a typical embodiment, and would be of generally rhomboidal configuration, with side edges 20 disposed in parallel relation to each other at angles of approximately 60°, in the illustrated preferred embodiment, to the parallel end edges 18 of the blank. At this point, it may be noted that this angle can be varied. Any angle falling in the range of 45°–70° is permissible, and allows use of commercial widths of panels, which are available in multiples of 12" or 16", or other widths divisible into 96".

At the several corners of the blank, notches are formed. Thus, at diagonally opposite corners there are identical but opposite notches 22, while at the other diagonally opposite corners of the blank there are provided identical but opposite notches 24.

Figure 7:
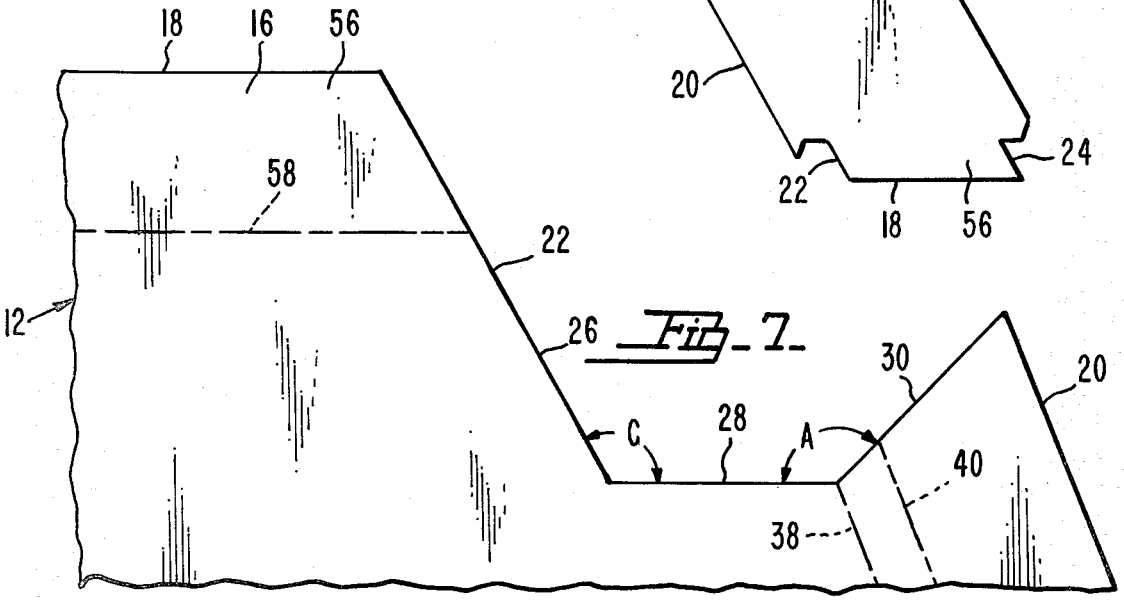
FIG. 7 is a view like FIG. 6 showing a second form of notch, located at the other, diagonally opposite corners of the panels shown in FIG. 5.

The particular form of the notches 22 may be noted by reference to FIG. 7. Each notch 22 is there shown as including an inner notch edge 26 formed straight and in parallel relation to the adjacent longitudinal edge 20 of the panel blank. Notch edge 22 merges into an intermediate edge 28 of the notch, which in turn merges into an outer notch edge 30 intersecting with the adjacent longitudinal edge 20 of the blank.

As will be noted from FIG. 7, the angles defined between edges 26, 28 and between edges 28 and 30 are re-entrant. The other pair of diagonally opposite notches 24 include a re-entrant angle defined between inner notch edge 32 and intermediate notch edge 34, and angle 34, 36 directed outwardly of the blank in which the notch is formed.

Referring now to FIG. 7, closely spaced, parallel fold lines 38, 40 are also parallel to longitudinal edge 20, extending from the notch in the area of the apex of angle A defined between edges 28, 30. Fold lines 42, 44, also disposed in closely spaced, parallel relation are extended in parallel relation to the longitudinal edges 20 of the blank, in the area of the apex of angle B (see FIG. 6) defined between notch edges 32, 34 of each notch 24.

Figure 6:
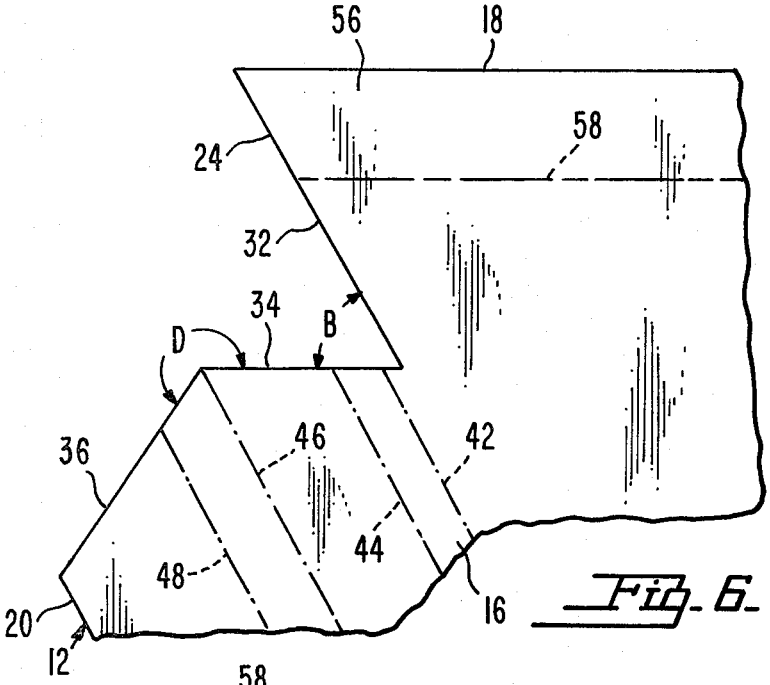
FIG. 6 is a greatly enlarged, fragmentary elevational view showing one corner of the panel blank illustrated in FIG. 5, illustrating a first notch formed at diagonally opposite corners of the panel.

Still referring to FIG. 6, between the inner set of fold lines 42, 44 and the adjacent longitudinal edge 20 of the blank, is an outer set of fold lines 46, 48. These are also parallel to each other and to the adjacent longitudinal edge 20 of the blank.

It may thus be noted at this point that the blank is so formed that viewing the blank as in FIG. 5, each end edge 18 is at an acute angle to one longitudinal edge 20, and at an obtuse angle to the other longitudinal edge 20. Where an obtuse angle is defined between an edge 18 and an edge 20, there is a notch 22 having two re-entrant angles A, C (FIG. 7). Conversely, where an acute angle is defined between an end edge 18 and a longitudinal edge 20, a notch 24 is formed having one re-entrant angle B and an angle D (FIG. 6) greater than 180° and hence directed outwardly from the blank.

It may also be noted that on each blank, there is along one side thereof, extending from the notch 22 to the notch 24 at that side, one set of fold lines 38, 40. Along the other side of the same blank, however, there are two sets of fold lines 42, 44 and 46, 48 respectively, extending between the notch 22 and the notch 24 of said other side.

Figure 4:
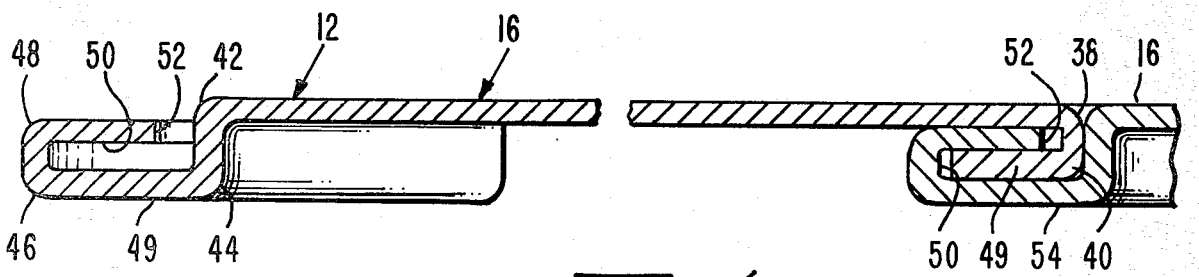
FIG. 4 is an enlarged, transverse sectional view through adjacent, connected panels of the barrel, taken substantially on line 4—4 of FIG. 3.

Referring now to FIG. 4, the folding of the blank along each of its sides is there illustrated. The provision of the fold lines 42, 44 and 46, 48 permit one side of the blank to be reversely folded upon itself with the folded portion defining a slot 50 extending along that side and opening over its entire length through a throat 52. The other side of the same blank is reversely folded along line 38, 40, to form a longitudinal tongue 54 entering through the throat 52 and engaged in the slot 54 of the next adjacent panel.

By reason of this inter-engagement of adjacent panels, shown to particular advantage in FIG. 4, each panel is connected along its opposite sides to adjacent panels, through the medium of rolled, interlocking seams 49. It will be understood, in this connection, that the folding and the interlocking of the panels is achieved all in a single manufacturing operation, it being a conventional manufacturing practice, in and of itself, to form rolled, interlocking seams connecting adjacent sheets or panels of metal material.

It is also known to inject a flowable sealant, not shown, into a rolled seam of the type illustrated, to render the same liquid-tight. The present invention does not concern itself with inventing liquid-tight drums per se, but rather, it is intended to here disclose a new drum-type container and a method of making the same, without regard to the material that would be carried thereby. In some cases, a container of this type may very likely be used for transporting granular material of a size that would prevent leakage of the material through the seams and through the connection of the barrel to the drum heads, in which event it would be unnecessary to insert sealant in the several connecting seams between the panels and between the panels and the drum heads. Other materials may be pelletized solids, and these would also render it unnecessary to make the container liquid-tight. Of course, where the container is used for transporting liquids, then indeed the injection of a sealant in the rolled seams may be desirable.

In any event, the seams are directed outwardly of the barrel as shown in FIG. 1, in the completed article. This is a feature of importance, which will be discussed in greater detail hereinafter.

Figure 8:
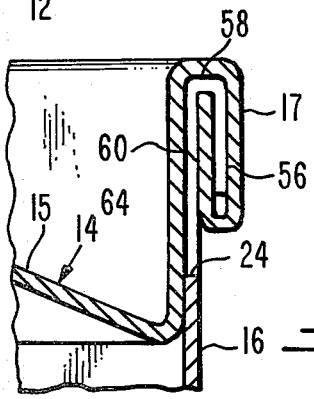
FIG. 8 is an enlarged, fragmentary, detail sectional view through the connection between the end of the barrel and one of the drum heads, taken substantially on line 8—8 of FIG. 1.

A plurality of panels connected as previously described herein, are rolled into a cylindrical form as in FIG. 1, and connected to drum heads or end panels 15. The connection is shown to particular advantage in FIGS. 8 and 9. In FIG. 8, the connection of an end panel to the drum head is shown at the location of one of the notches 22 or 24. In either of these notch locations, the rolled seam is caused to terminate short of the connection between the panel and the drum head, due to the provision of the notch, as shown clearly in FIG. 8.

The provision of the notches at each end of a panel define foldable end flanges 56 on the respective panels, foldable along a line 58 extending transversely of the panel between the notches at each end. When the panel is folded outwardly as shown in FIG. 8, it enters a slot formed by a double-folding of the peripheral portion of the drum head 14, the folded portion of the drum head being designated 60 and being interlocked with the outwardly folded end flange 56. Again, a sealant can be inserted for the purpose of rendering the container substantially liquid-tight.

It is desired that the body portion of the end panel be offset inwardly as shown in FIG. 8, to a greater extent than has been the general practice in conventional drum manufacture. Further, the circular body portion of the end panel is preferably rendered outwardly concavo-convex as shown in FIGS. 8 and 9.

Figure 9:
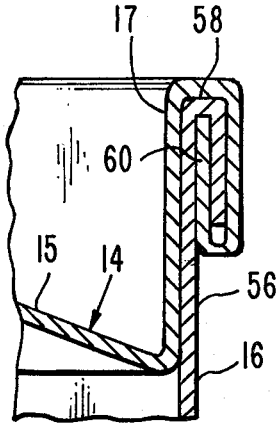
FIG. 9 is an enlarged, detailed sectional view taken substantially on line 9—9 of FIG. 1.

FIG. 9 illustrates the roll-formed connection between the barrel and the drum head at locations intermediate the notches of the end panels. Here, there is no problem between the outwardly directed, circular seam produced by connection of each drum head to the barrel, and the helical seams extending from end-to-end of the barrel to provide connections between adjacent side wall panels 16.

In some instances, it may be desired to apply a retaining ring to the edges of a drum head and barrel. This ring would be rolled into engagement with both the drum head and the barrel, and would be readily removed when the drum is to be opened.

A shipping drum formed according to the present invention has certain advantages not found in conventional shipping drums of the type previously described herein. Welding is completely eliminated, and manufacturing operations are comparatively simple, following the present invention.

In making the drum, one may form the barrel material in continuous sheets or rolls, which can be sheared as part of a continuous manufacturing process, producing the panels in the shape shown in FIG. 5. The barrel would be formed by winding the panels 16 into a helix, following shearing of the panels to the configuration illustrated in blank in FIG. 5. The notches 22, 24 would be formed immediately prior to the interlocking of adjacent panels in side-by-side relation, or indeed, in some instances the notches would be formed after the panels have been connected together by the helical, rolled seams 49.

In essence, the helical seams 49 will extend only to the point where metal deformation begins at the ends of the barrel, where the circumferential joint between the barrel and the drum heads (shown in FIGS. 8 and 9) begins. The joint between the drum heads and the barrel ends has been designated, at each end of the barrel, by reference numeral 62 in FIG. 1.

To insure tightness, the inner lip on the drum head will extend into the barrel, past the termination of the helical rolled formed joint, as shown in FIG. 8, so that the metal-to-metal contact and/or a sealant will assure tightness at the joint location between the drum head and the barrel end.

The drum heads will follow conventional practice except that the inner lip 64 (see FIG. 8) would extend more deeply into the barrel (perhaps on the order of about ½ inch) to assist in maintaining tightness. This may be accomplished either by increasing the overall height of the head lip (that is, by increasing the overall height of the drum itself) or by recessing a groove around the periphery of the head while maintaining or reducing the normal drum height.

The drum heads may, if desired, have embossed patterns, not shown, to improve strength. Conventional drums ordinarily use flat heads, with local embossing for bung holes, vents, and the like. This requires a heavier gauge metal than is required for a head with properly designed embossing.

Displacing the helical roll formed seams 49 toward the outside of the barrel offers a two-fold advantage. First, a reasonably smooth interior is necessary for proper application of the drum heads. Secondly, the exterior helix will effectively delineate the points of contact between adjacent drums, and will limit the damage caused by such contact. Rolling rings are provided on most conventional drums to maintain circularity. These, however, become offset in actual practice, when space develops between adjacent drums. As a result, the strong, outwardly directed rolling ring may damage weaker portions of the next adjacent barrel, when the rolling rings of adjacent barrels are offset from each other.

In the present invention, this cannot happen. The seams 49 are thinner in cross-section than the present rolling rings used on conventional drums, and have flatter exterior surfaces. For example, it is proposed that the height of each seam 49 would be on the order of about 5/16 inch. A "rolling ring" on a conventional drum, to the contrary, has a height of about ¾ inch. As a result, drums made according to the present invention will move through a much smaller distance before contact is made, thus reducing dynamic effects, and causing the impact to be taken over a wider plate area with corresponding reduction of damage.

Additionally, local embossing may be added to the skelp before it is formed into the barrel helix. This may be used to reduce the gauge of the metal, increase the local panel stiffness, or both.

A further advantage in the present invention is that coatings previously applied to the barrel and end panel materials are not lost during the manufacturing process. This is not true when welds are employed to form the barrels. By permitting the application of coatings before manufacture of the barrel, rather than afterwards as in conventional practice, one can improve quality control, and at the same time reduce cost.

The intersection of the helical seams 49 with the circular end seams 62 is important to the success of the construction. The external portions of each helical seam 49 is essentially removed where it would interfere with external portions of the circular joints 62, except for that material required to form an interference fit between butting pieces of metal. By lapping the end of the helical joints 49 with a circumferential drum head joints 62, reliance on the tightness of butt joints is avoided, and overall reliability of the system is enhanced.

With respect to the sealant that is applicable in some instances, this can be applied in a number of ways. A layer can, for example, be brushed, sprayed, or glued on. Or, the sealing could be effected by crushing a tape or strip into place. Still further, the sealant could be part of the overall coating of the base metal. And, since the rolled seams are flattened in the present invention, effective metal-to-metal contact can be achieved, to minimize the areas that have to be sealed off against leakage.

Figure 3:
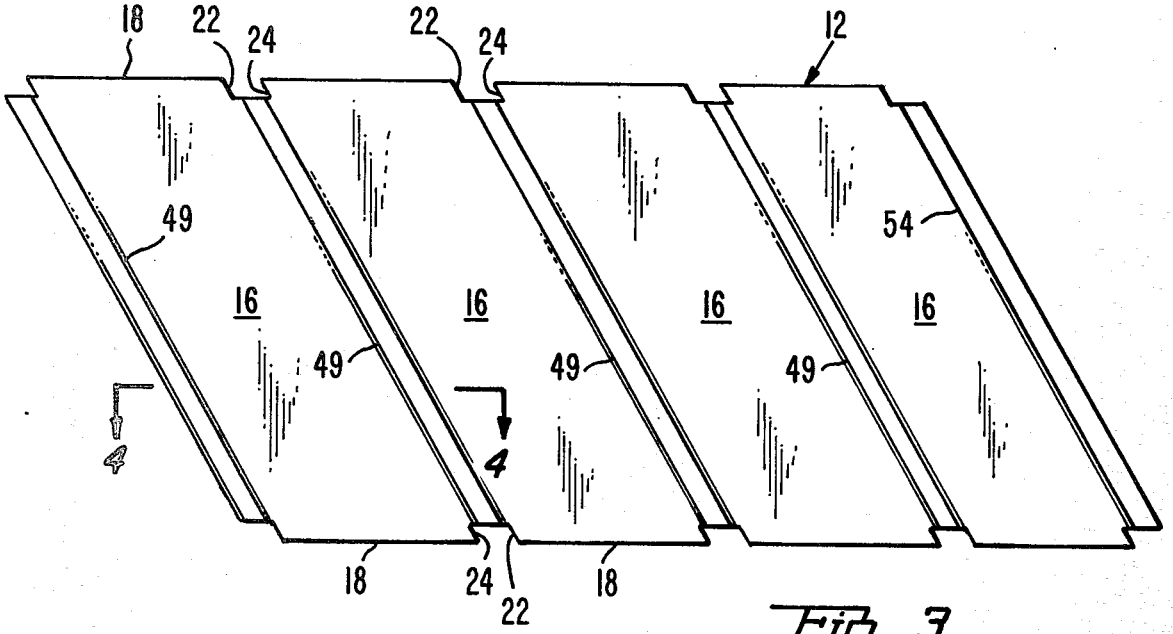
FIG. 3 is a developed view of the barrel per se.

It is worthy of note that the capacity of the drum can be varied by varying the length of the skelp, that is the distance between the end edges 18 of a panel viewed as in FIG. 3. This can be done without changing the tooling used in making the drum and provides an important commercial advantage over conventional drums of the type hereinbefore described, the capacities of which cannot be changed in this way.

It may also be noted that although the invention has been illustrated and described as comprising a plurality of panels 16, it is entirely possible that only one of said panels may be used, with its opposite edges being interlocked in the manner described above to provide a single helical seam.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A container of the drum type comprising:

(a) a barrel formed of a plurality of side-by-side, rhomboidal lengths of skelp formed of sheet metal material and rolled into the form of a straight hollow cylinder constant in diameter from end to end thereof;

(b) a pair of circular drum heads also formed of sheet metal and closing the ends of the barrel; and (c) means for joining the heads to the barrel ends and for connecting the several lengths of skelp to each other, said means lying wholly exteriorly of the barrel and being in the form of flat, outwardly rolled end seams joining the heads to the barrel ends, and flat, outwardly rolled side seams joining said lengths to each other, all of said seams projecting radially outwardly beyond the outer diameter of the barrel to the same extent and comprising, exteriorly of the barrel, a plurality of thicknesses of the material lying in face-to-face contact along the outside of the barrel, thus to provide a minimum projection outside the barrel and thereby minimize damage to side-by-side drums upon their being relatively offset and impacting each other during regular use, each axial end of each side seam being spaced axially inwardly of the nearest respective end seam and opened towards the end seam adjacent the respective drum head.

2. A container as in claim 1 wherein there are three thicknesses of the sheet material folded into interlocking relation to provide each end and side seam.

3. A container of the drum type, comprising:

(a) a barrel formed of a plurality of side wall panels connected in side-by-side relation and rolled into the form of a cylinder, each panel being of rhomboidal configuration and having opposite but identical first notches at first, diagonally opposite corners thereof, each panel also having identical but opposite second notches at second, diagonally opposite corners thereof, the first notches of each panel communicating with the second notches of adjacent panels, the several sets of communicating notches defining between them foldable end flanges on the several panels, each of the panels being connected along its opposite sides to adjacent panels by rolled, interlocking, side wall seams that end at the communicating notches; and (b) heads closing the opposite ends of the cylinder, each head having a continuous unbroken peripheral portion folded over the end flanges in interlocking relation therewith, to provide rolled end seams in which the peripheral portions overlie the notches and cover the end flanges in their entirety.

4. A container as in claim 3 wherein the communicating notches of each set are of a depth exceeding that of the folded peripheral portions and end flanges to constitute the notches as a means for terminating the interlocking side wall seams short of the end seams, the side seams terminating at the starting locations of the rolled end seams.

5. A container as in claim 4 wherein the heads have inner lips disposed radially inwardly of the end seams and extending into the barrel to a depth exceeding that of the end seams, and also exceeding the depth of said communicating notches.

6. A container as in claim 5 in which the panels have side edges extending at angles to the end edges falling in the range of 45° to 70°.

7. A container as in claim 6 in which, in the blank form of each panel, each of the first notches includes an inner notch edge that is straight, and is in spaced relation to the adjacent side edge of the panel in which it is formed.

8. A container as in claim 7 in which, in the blank form of each panel, the inner notch edge of each of the first notches merges into an intermediate notch edge parallel to the panel end edge adjacent thereto, said intermediate and inner notch edges defining a re-entrant angle therebetween, the intermediate notch edge merging into an outer notch edge intersecting with the adjacent side edge of the panel, the intermediate and outer notch edges defining a second re-entrant angle therebetween, each of the second notches including a straight inner notch edge parallel to the panel side edge adjacent thereto, an intermediate notch edge parallel to the panel end edge adjacent thereto and cooperating with the inner notch edge to define a re-entrant angle therebetween, and an outer notch edge disposed at an obtuse angle to the inner edge.

9. A container as in claim 8 in which, when adjacent panels are connected by an interlocking side seam, the inner notch edges are disposed at opposite sides of the side seam, and the intermediate and outer edges of the communicating notches are substantially in registration with each other and are intersected by the side seam.

10. A container as in claim 9 wherein the inner notch edges of the first and second notches are in parallel relation to the side edges of the panels in which they are formed.

* * * * *